United States Patent [19]

Morishita et al.

[11] 4,361,287

[45] Nov. 30, 1982

[54] ROTARY TYPE ELECTROSTATIC SPRAY PAINTING DEVICE

[75] Inventors: Teru Morishita, Shizuoka; Matsuyoshi Sugiyama, Susono; Toshikazu Suzuki, Toyota, all of Japan

[73] Assignee: Toyota Jidosha Kogyo Kabushiki Kaisha, Toyota, Japan

[21] Appl. No.: 176,332

[22] Filed: Aug. 8, 1980

[30] Foreign Application Priority Data

Apr. 4, 1980 [JP] Japan ..... 55-443449

[51] Int. Cl.[3] ..... B05B 5/04

[52] U.S. Cl. ..... 239/703; 239/223

[58] Field of Search ..... 239/700–703, 239/223, 224; 118/323, 621, 626, 627, 629, 631; 308/9, 15, 121, 122, 168, 170, 174, DIG. 1

[56] References Cited

U.S. PATENT DOCUMENTS

| | | | |
|---|---|---|---|
| 3,063,642 | 11/1962 | Point | 118/627 X |
| 3,128,045 | 4/1964 | Gauthier | 239/703 |
| 3,985,405 | 12/1976 | Okano et al. | 308/DIG. 1 X |
| 4,148,932 | 4/1979 | Tada et al. | 239/700 X |

FOREIGN PATENT DOCUMENTS

| | | | |
|---|---|---|---|
| 2336181 | 7/1977 | France | 239/703 |
| 962030 | 6/1964 | United Kingdom | 239/700 |
| 1213959 | 11/1970 | United Kingdom | 308/9 |
| 709858 | 1/1980 | U.S.S.R. | 308/9 |

*Primary Examiner*—Andres Kashnikow
*Attorney, Agent, or Firm*—Kenyon & Kenyon

[57] ABSTRACT

A rotary type electrostatic spray painting device comprising a rotary shaft and a spray head fixed onto the front end of the rotary shaft. The spray head comprises a cylindrical inner wall, a plurality of paint outflow bores radially outwardly extending from the cylindrical inner wall, and a cup shaped inner wall radially outwardly extending from the paint outflow bores. Paint is injected onto the cylindrical inner wall of the spray head. The rotary shaft is supported by a single thrust air bearing and a pair of radial air bearings. An electrode, continuously contacting the rear end of the rotary shaft, is provided. A negative high voltage is applied to the housing of the paint device. In addition, the negative high voltage is also applied to the spray head via the electrode and the rotary shaft.

19 Claims, 9 Drawing Figures

ROTARY TYPE ELECTROSTATIC SPRAY PAINTING DEVICE

BACKGROUND OF THE INVENTION

The present invention relates to a rotary type electrostatic spray painting device.

One known electrostatic spray painting device which has been used for painting, for example, bodies of motor cars, is of the rotary type and comprises a rotary shaft supported by ball bearings or roller bearings arranged within the housing of the painting device, and a cup shaped spray head fixed onto the front end of the rotary shaft. In this painting device, a negative high voltage is applied to the spray head, and paint is fed onto the inner circumferential wall of the spray head. Thus, fine paint particles charged with electrons are sprayed from the spray head and are attracted by an electrostatic force onto the surface of the body of a motor car, which is grounded. As a result of this, the surface of the body of a motor car is painted. In such a rotary type electrostatic spray painting device, about 90 percent of the paint sprayed from the spray head can be efficiently used for painting the surface to be painted. Thus, the amount of the paint which is wasted is small and, as a result, rotary type electrostatic spray painting devices are used in various industries.

In order to form a beautifully finished surface when the surface is painted by using a spray paint, it is necessary to reduce the size of the particles of paint as much as possible. In rotary spray painting arrangements wherein the paint is divided into fine particles by operation of a centrifugal force which results from the rotation of the spray head, the strength of the centrifugal force, that is, the rotating speed of the spray head, has a great influence on the size of the particles of paint. In other words, the higher the rotating speed of the spray head, the smaller the size of the particles of paint. Consequently, in order to form a beautifully finished surface by using a rotary type electrostatic spray painting device, it is necessary to increase the rotating speed of the spray head as much as possible. As mentioned above, in a conventional rotary type electrostatic spray painting device, ball bearings or roller bearings are used for supporting the rotary shaft of the electrostatic spray painting device and, in addition, a lubricant, such as grease, is confined within the ball bearings or the roller bearings. However, when such bearings, which are lubricated by grease, are rotated at a high speed, the bearings instantaneously deteriorate. Therefore, in a conventional rotary type electrostatic spray painting device having bearings which are lubricated by grease, the maximum rotating speed of the rotary shaft, and therefore of the spray head, is at most 20,000 r.p.m. However, in the case wherein the rotating speed of the spray head is about 20,000 r.p.m., the size of the particles of paint is relatively large and, thus, it is difficult to form a beautifully finished surface. In the field of manufacturing motor cars, the painting process for bodies of motor cars comprises a primary spraying step, an undercoating step and a finish painting step. However, since it is difficult to form a beautifully finished surface by using a conventional rotary type electrostatic spray painting device, as mentioned above, such a conventional rotary type electrostatic spray painting device has been used for the undercoating step, but not the finish painting step.

A jet lubricating system is known wherein low viscosity lubricating oil is injected into the region between the inner race and the outer race of the ball or roller bearing. The friction between the ball or roller and such races is greatly reduced and, at the same time, the heat caused by the friction is absorbed by the lubricating oil. In arrangements where the above-mentioned jet lubricating system is applied to a rotary type electrostatic spray painting device, it is possible to increase the rotating speed of the rotary shaft of the electrostatic spray painting device as compared arrangements where grease lubricated bearings are used. However, since the jet lubricating system requires a complicated lubricating oil feed device having a large size, it is particularly difficult to apply such a jet lubricating system to a rotary type electrostatic spray painting device. In addition, if the lubricating oil mixes with the paint, the appearance of the painted surface is damaged. Therefore, if the jet lubricating system is applied to a rotary type electrostatic spray painting device, it is necessary to completely prevent the lubricating oil from leaking into the paint. However, it is practically impossible to completely prevent the lubricating oil from leaking into the paint and, thus, it is inadvisable to apply the jet lubricating system to a rotary type electrostatic spray painting device.

A further known painting device which is capable of reducing the size of the particles of paint to a great extent employs an air injection scheme in which the paint is divided into fine particles by the stream of injection air. In this air injection type electrostatic spray painting device, since the size of the particles of sprayed paint can be reduced to a great extent, as mentioned above, it is possible to form a beautifully finished surface. Consequently, the air injection type electrostatic spray painting device has performed the finish painting step for the bodies of motor cars. However, in such an air injection type electrostatic spray painting device, since the sprayed paint impinges upon the surface to be painted together with the stream of the injection air, and a large amount of the sprayed paint escapes with the stream of the injection air without adhering to the surface to be painted. In such systems, the amount of the paint used to effectively paint the surface to be painted is about 40 percent of the amount of the paint sprayed from the electrostatic spray painting device. Consequently, in situations where an air injection type electrostatic spray painting device is used, the consumption of the paint is inevitably increased. In addition, in this case, a problem occurs in that the paint escaping, together with the stream of the injection air, causes air pollution within factories.

It is, therefore, an object of the present invention to provide a rotary type electrostatic spray painting device capable of reducing the size of the particles of paint to be sprayed and the quantity of paint used.

SUMMARY OF THE INVENTION

According to the present invention, there is provided a rotary type elctrostatic spray painting device comprising: a metallic housing; a metallic rotary shaft rotatably arranged in said housing and having a front end and a rear end; a cup shaped metallic spray head fixed onto the front end of said rotary shaft and having a cup shaped inner wall and an approximately cylindrical inner wall which is spaced radially inwardly from said cup shaped inner wall and defines an annular space therein. The approximately cylindrical inner wall is arranged coaxially with a rotation axis of said rotary shaft and is provided with a plurality of paint outflow bores, each being formed in said approximately cylindrical inner wall and smoothly connected to said cup shaped inner wall. A feed means is provided having a paint injection nozzle which is arranged in said annular space and which is directed to said approximately cylindrical inner wall for feeding a paint onto said approximately cylindrical inner wall. The device further comprises drive means cooperating with said rotary shaft for rotating said rotary shaft; non-contact type radial bearing means arranged in said housing and cooperating with said rotary shaft for radially supporting said rotary shaft under a non-contacting state; and non-contact type thrust bearing means arranged in said housing and cooperating with said rotary shaft for axially supporting said rotary shaft under a non-contacting state. A terminal for receiving a negative high voltage is connected to said housing, and an electrode is arranged in said housing for electrically connecting said terminal to said spray head.

The present invention may be more fully understood by reading the description of preferred embodiments of the invention set forth below, together with the accompanying drawings.

DETAILED DESCRIPTION OF PREFERRED EMBODIMENTS

Figure 1:
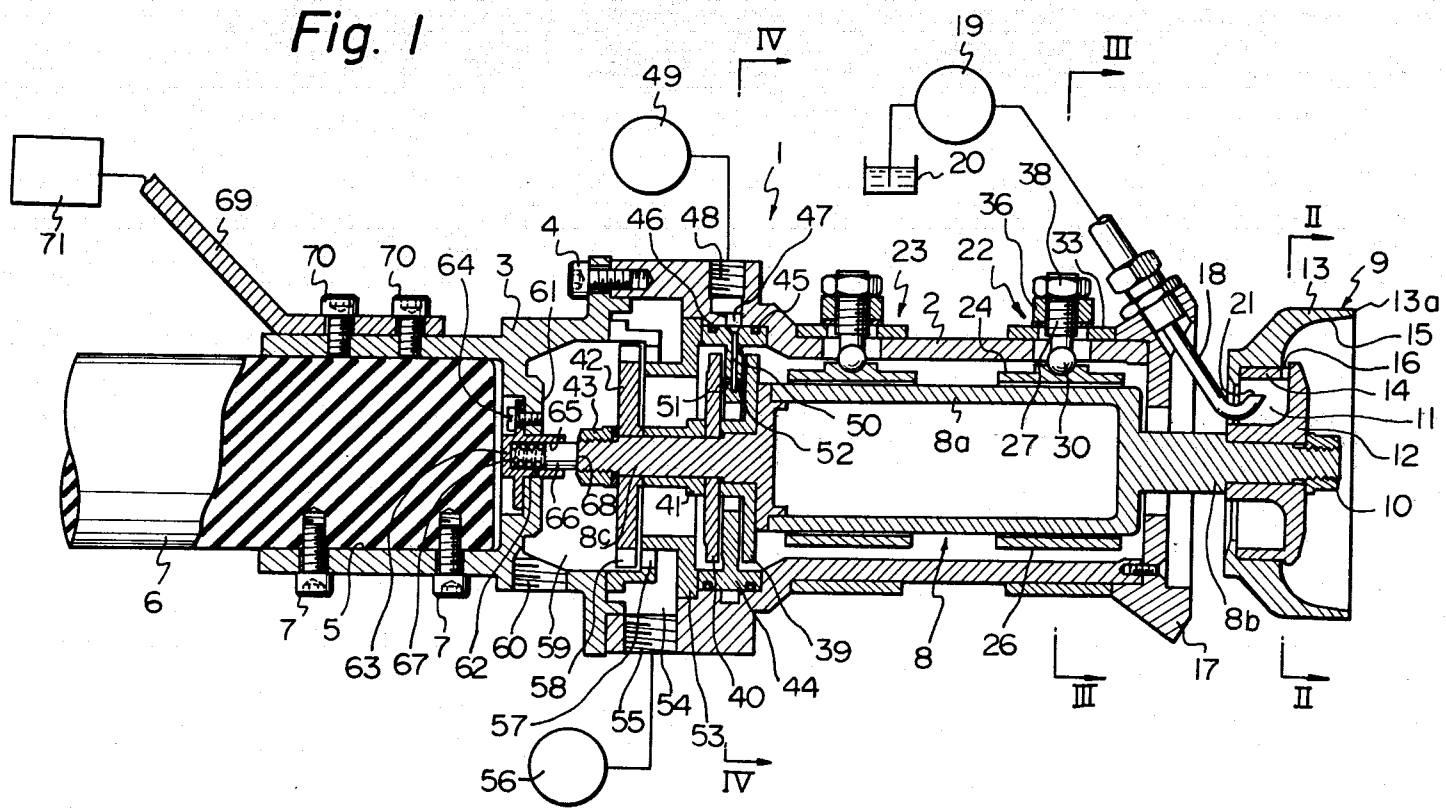
FIG. 1 is a cross-sectional side view of an embodiment of a rotary type electrostatic spray paint device according to the present invention.
Figure 2:
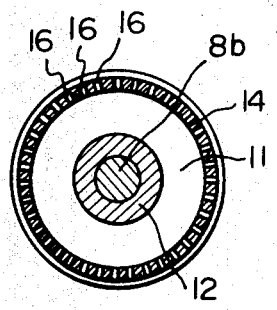
FIG. 2 is a cross-sectional view taken along the line II—II in FIG. 1.
Figure 5:
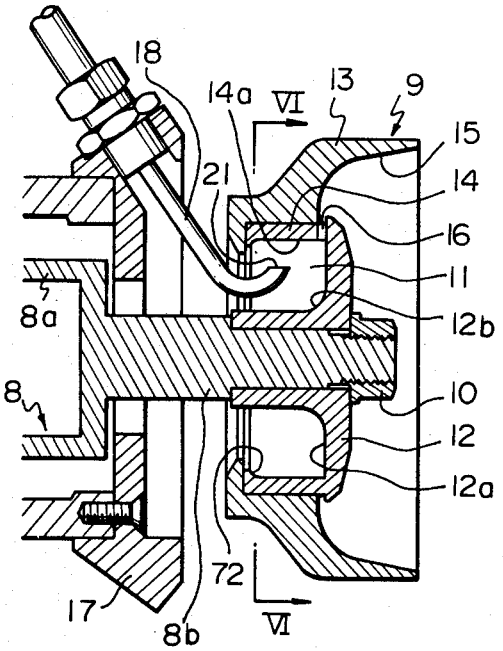
FIG. 5 is an enlarged cross-sectional side view of the spray head illustrated in FIG. 1.
Figure 6:
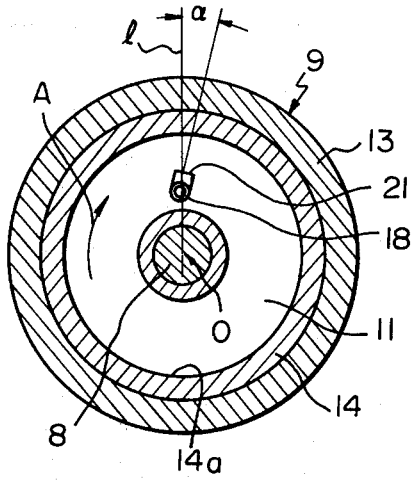
FIG. 6 is a cross-sectional view taken along the line VI—VI in FIG. 5.

Referring to FIG. 1, a rotary type electrostatic spray painting device, generally designated by reference numeral 1, comprises a generally hollow cylindrical front housing 2 made of metallic material, and a generally hollow cylindrical rear housing 3 made of metallic material. The front housing 2 and the rear housing 3 are firmly joined to each other by bolts 4. A support rod 6, made of electrically insulating material, is fitted into a cylindrical hole 5 formed in the rear housing 3, and this rear housing 3 is fixed onto the support rod 6 by bolts 7. The support rod 6 is supported by a base (not shown). A rotary shaft 8 is inserted into the front housing 2. This rotary shaft 8 comprises a hollow cylindrical portion 8*a* located in the middle thereof, a shaft portion 8*b* formed in one piece on the front end of the hollow cylindrical portion 8*a*, and a shaft portion 8*c* fixed onto the rear end of the hollow cylindrical portion 8*a*. A spray head 9 made of metallic material is fixed onto the shaft portion 8*b* of the rotary shaft 8 by a nut 10. The spray head 9 comprises a spray head supporting member 12 forming therein an annular space 11, and a cup shaped spray head body 13 fixed onto the spray head supporting member 12. As illustrated in FIGS. 1 and 2, a plurality of paint outflow bores 16, each opening into the annular space 11 and smoothly connected to an inner wall 15 of the spray head body 13, is formed in an outer cylindrical portion 14 of the spray head supporting member 12. As illustrated in FIG. 1, an end plate 17 is fixed onto the front end of the front housing 2, and a paint injector 18 is mounted on the end plate 17. The paint injector 18 is connected to a paint reservoir 20 via a paint feed pump 19 and, as illustrated in FIG. 5, a nozzle 21 of the paint injector 18 is directed to the central portion of the cylindrical inner wall 14*a* of the outer cylindrical portion 14. In addition, in FIG. 6, if the spray head 9 rotates in the direction indicated by the arrow A, the direction of the nozzle 21 of the paint injector 18 is arranged to be inclined by an angle $\alpha$ towards the rotating direction of the spray head 9 with respect to the line l passing through the nozzle 21 and the rotation axis 0 of the rotary shaft 8.

Figure 3:
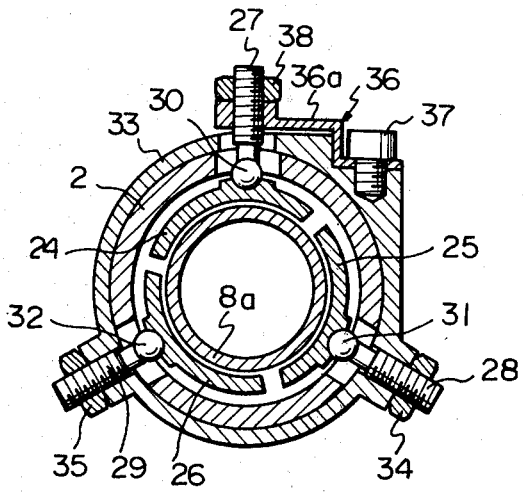
FIG. 3 is a cross-sectional view taken along the line III—III in FIG. 1.

As illustrated in FIG. 1, a pair of non-contact type tilting pad radial air bearings 22 and 23 is arranged in the front housing 2, and the rotary shaft 8 is rotatably supported on the front housing 2 via a pair of the tilting pad radial air bearings 22 and 23. Both the tilting pad radial air bearings 22 and 23 have the same construction and, therefore, the construction of only the tilting pad radial air bearing 22 will be hereinafter described. Referring to FIGS. 1 and 3, the tilting pad radial air bearing 22 comprises three pads 24, 25, 26 arranged to be spaced from the outer circumferential wall of the hollow cylindrical portion 8*a* of the rotary shaft 8 by an extremely small distance, and three support pins 27, 28, 29 supporting the pads 24, 25, 26, respectively. Spherical tips 30, 31, 32 are formed in one piece on the inner ends of the support pins 27, 28, 29 and are in engagement with spherical recesses formed on the rear faces of the pads 24, 25, 26, respectively. Consequently, the pads 24, 25, 26 can swing about the corresponding spherical tips 30, 31, 32, each functioning as a fulcrum. A bearing support frame 33 is fixed onto the outer circumferential wall of the front housing 2 by means of, for example, bolts (not shown), and the support pins 28, 29 are fixed onto the bearing support frame 33 by means of nuts 34, 35, respectively. In addition, one end of a support arm 36 having a resilient plate shaped portion 36*a* is fixed onto the bearing support frame 33 by means of a bolt 37, and the other end of the support arm 36 is fixed onto the support pin 27 by means of a nut 38. Consequently, the pad 24 is urged onto the hollow cylindrical portion 8*a* of the rotary shaft 8 due to the resilient force of the support arm 36.

Figure 4:
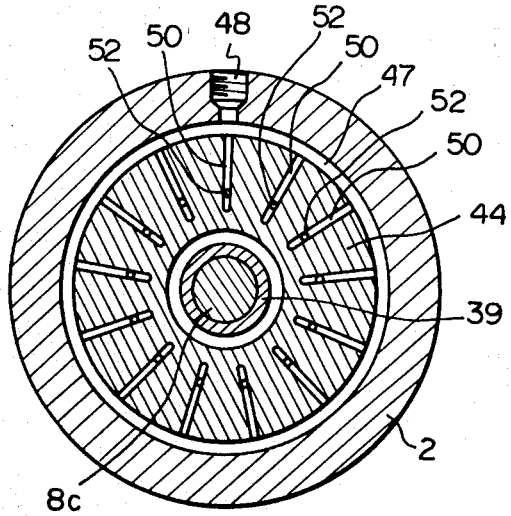
FIG. 4 is a cross-sectional view taken along the line IV—IV in FIG. 1.

Turning to FIG. 1, a pair of disc shaped runners 39, 40 is inserted into the shaft portion 8*c* of the rotary shaft 8 and fixed onto the shaft portion 8*c* via a spacer 41 and a turbine wheel 42 by means of a nut 43. A stationary annular plate 44 is arranged between the runners 39 and 40, and the runners 39, 40 and the annular plate 44 construct a non-contact type thrust air bearing. As illustrated in FIG. 1, each of the runners 39, 40 is arranged to be spaced from the annular plate 44 by a slight distance. The annular plate 44 is fixed onto the front housing 2 via a pair of O-rings 45, 46. As illustrated in FIGS. 1 and 4, an annular groove 47, extending along the outer circumferential wall of the annular plate 44, is formed on the inner wall of the front housing 2 and connected to an air feed pump 49 via a compressed air supply hole 48 which is formed in the front housing 2. A plurality of air passages 50, each extending radially inward from the annular groove 47, is formed in the annular plate 44. In addition, a plurality of air outflow bores 51, each extending towards the runner 40 from the inner end portion of the corresponding air passage 50, is formed in the annular plate 44, and a plurality of air outflow bores 52, each extending towards the runner 39 from the inner end portion of the corresponding air passage 50, is formed in the annular plate 44.

As illustrated in FIG. 1, a turbine nozzle holder 53 is fixed onto the front housing 2 at a position adjacent to the annular plate 44, and an annular air supply chamber 54 is formed between the turbine nozzle holder 53 and the front housing 2. The air supply chamber 54 is connected to a compressor 56 via a compressed air supply hole 55. The air supply chamber 54 comprises a compressed air injecting nozzle 57 having a plurality of guide vanes (not shown), and turbine blades 58 of the turbine wheel 42 are arranged to face the compressed air injecting nozzle 57. A housing interior chamber 59, in which the turbine wheel 42 is arranged, is connected to the atmosphere via a discharge hole 60 which is formed in the rear housing 3. The compressed air fed into the air supply chamber 54 from the compressor 56 is injected into the housing interior chamber 59 via the compressed air injecting nozzle 57. At this time, the compressed air injected from the injecting nozzle 57 provides the rotational force for the turbine wheel 42 and, thus, the rotary shaft 8 is rotated at a high speed. Then, the compressed air injected from the injecting nozzle 57 is discharged to the atmosphere via the discharge hole 60.

A through-hole 62 is formed on an end wall 61 of the rear housing 3, which defines the housing interior chamber 59, and an electrode holder 63 extending through the through-hole 62 is fixed onto the end wall 61 by means of bolts 64. A cylindrical hole 65 is formed coaxially with the rotation axis of the rotary shaft 8 in the electrode holder 63, and a cylindrical electrode 66, made of wear resisting materials such as carbon, is inserted into the cylindrical hole 65 so as to be movable therein. In addition, a compression spring 67 is inserted between the electrode 66 and the electrode holder 63 so that the tip face 68 of the electrode 66 is urged onto the end face of the shaft portion 8c of the rotary shaft 8 due to the spring force of the compression spring 67. An external terminal 69 is fixed onto the outer wall of the rear housing 3 by means of bolts 70 and connected to a high voltage generator 71 used for generating a negative high voltage ranging from −60 KV to −90 KV. Consequently, the negative high voltage is applied to both the front housing 2 and the rear housing 3, and it is also applied to the spray head 9 via the electrode 66 and the rotary shaft 8.

As mentioned previously, the rotary shaft 8 is supported by a pair of the tilting pad radial air bearings 22, 23, and a single thrust air bearing which is constructed by the runners 39, 40 and the stationary annular plate 44. In the tilting pad radial air bearings 22, 23, when the rotary shaft 8 is rotated, ambient air is sucked into the extremely small clearances formed between the hollow cylindrical portion 8a and the pads 24, 25, 26. Then, the air thus sucked is compressed between the hollow cylindrical portion 8a and the pads 24, 25, 26 due to a so-called "wedge effect" of air, and therefore, the pressure of the air between the hollow cylindrical portion 8a and the pads 24, 25, 26 is increased. As a result of this, the force radially supporting the rotary shaft 8 is generated between the hollow cylindrical portion 8a and the pads 24, 25, 26. On the other hand, in the above-mentioned thrust air bearing, compressed air is fed into the air passages 50 from the air feed pumps 49 via the annular groove 47. Then, the compressed air is injected from the air outflow bores 51 into the clearance between the annular plate 44 and the runner 40, and also, injected from the air outflow bores 52 into the clearance between the annular plate 44 and the runner 39. As a result of this, the pressure, which is necessary to maintain the above-mentioned clearances formed on each side of the annular plate 44, is generated between the annular plate 44 and the runners 39, 40. Consequently, the rotary shaft 8 is supported by the thrust air bearing and a pair of the radial air bearings under a non-contacting state via a thin air layer. As is known to those skilled in the art, the coefficient of viscosity of air is about one thousandth of that of the viscosity of lubricating oil. Consequently, the frictional loss of the air bearing, which uses air as a lubricant, is extremely small. Therefore, since the amount of heat caused by the occurence of the frictional loss is extremely small, it is possible to increase the rotating speed of the rotary shaft 8 to a great extent. In the embodiment illustrated in FIG. 1, it is possible to rotate the rotary shaft 8 at a high speed of about 80,000 r.p.m.

Figure 7:
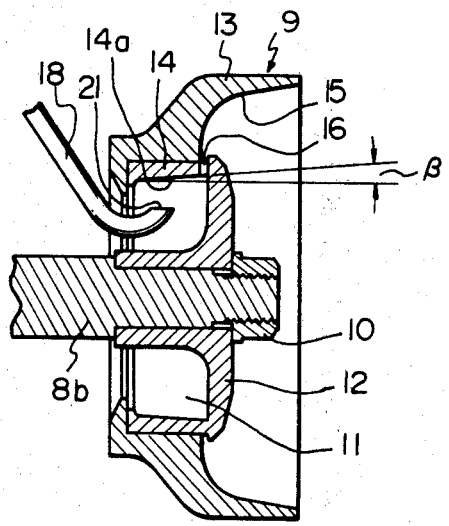
FIG. 7 is an enlarged cross-sectional side view of an alternative embodiment of a spray head according to the present invention.
Figure 8:
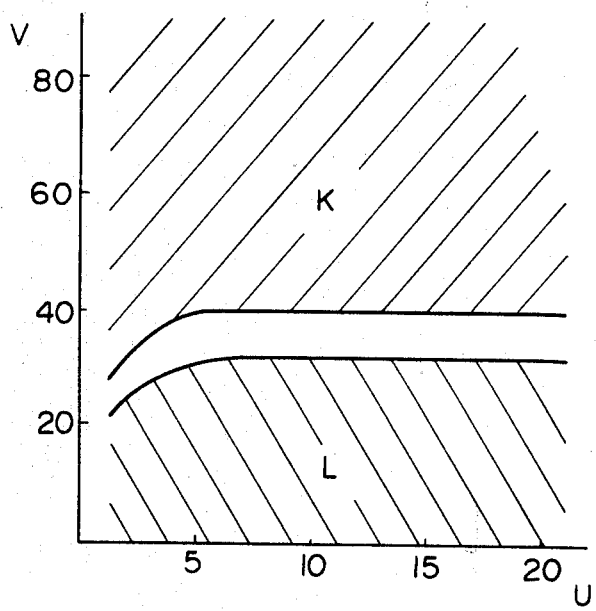
FIG. 8 is a graph illustrating a region wherein paint, injected onto the inner wall of a spray head, is caused to fly away therefrom, and illustrating a region wherein paint, injected onto the inner wall of a spray head, adheres thereon.

As mentioned previously, in a rotary type electrostatic spray painting device according to the present invention, since the nozzle 21 of the paint injector 18 is directed to the central portion of the cylindrical inner wall 14a of the outer cylindrical portion 14, the paint is injected from the nozzle 21 onto the cylindrical inner wall 14a of the outer cylindrical portion 14. However, in a conventional rotary type electrostatic spray painting device, as illustrated in FIG. 5, the nozzle of a paint injector is directed to the vertically extending annular inner wall 12a of the spray head supporting member 12 or the curved inner end 12b of the annular inner wall 12a. Nevertheless, if paint is injected towards the annular inner wall 12a or the curved inner end 12b thereof in the case wherein the spray head 9 rotates at a high speed of about 80,000 r.p.m., as in the present invention, a problem occurs in that the paint is caused to fly away from the annular inner wall 12a. FIG. 8 illustrates a result of experiments when paint is injected onto the annular inner wall 12a of the spray head supporting member 12. In FIG. 8, the ordinate V indicates the circumferential velocity (m/sec) of a portion of the annular inner wall 12a, onto which the spray is injected, and the abscissa U indicates the velocity (m/sec) of the paint injected from the paint injector. In addition, in FIG. 8, the hatching K indicates a region wherein the paint, injected onto the annular inner wall 12a, is caused to fly away from the annular inner wall 12a, and the hatching L indicates a region wherein the paint, injected onto the annular inner wall 12a, adheres onto the annular inner wall 12a. From FIG. 8, it will be understood that, if the velocity U of the paint, injected from the paint injector, is above 5 m/sec, when the circumferential velocity V becomes larger than 40 m/sec, the paint, injected onto the annular inner wall 12*a*, is caused to fly away from the annular inner wall 12*a* independently of the velocity U. In the case wherein the spray head 9, having a diameter of about 75 mm, rotates at 80,000 r.p.m., the circumferential velocity V of an approximately central portion of the annular inner wall 12*a* becomes equal to about 90 m/sec. Consequently, in this case, it will be understood that the paint, injected onto the annular inner wall 12*a*, is caused to completely fly away therefrom. In order to prevent the paint from flying away, in the present invention, the nozzle 21 of the paint injector 18 is directed to the central portion of the cylindrical inner wall 14*a* of the outer cylindrical portion 14. The cylindrical inner wall 14*a* has a uniform diameter over the entire length thereof and is arranged coaxially with the rotation axis of the rotary shaft 8. When the paint is injected onto the cylindrical inner wall 14*a* of the outer cylindrical portion 14, the paint spreads over the entire area of the cylindrical inner wall 14*a* in the form of a thin film, due to the centrifugal force, without flying away from the cylindrical inner wall 14*a*. If the paint is injected towards the paint outflow bores 16, the paint impinges on the paint outflow bores 16 and is caused to fly away. Consequently, it is not preferable that the nozzle 21 be arranged to be directed towards the paint outflow bores 16. In addition, as mentioned previously with reference to FIG. 6, the direction of the nozzle 21 is arranged to be inclined by an angle $\alpha$ towards the rotating direction of the spray head 9 with respect to the line l. It is preferable that the angle $\alpha$ be within the range of about 0 through 60 degrees. That is, if the nozzle 21 is arranged to be inclined towards a direction opposite to the rotating direction, illustrated by the arrow A in FIG. 6, with respect to the line l, the paint is caused to fly away from the cylindrical inner wall 14*a*. Consequently, it is preferable that the direction of the nozzle 21 be directed in almost the same direction as that of the extension of the line l or slightly inclined towards the rotating direction, illustrated by the arrow A in FIG. 6, with respect to the line l. In addition, as illustrated in FIG. 7, the inner wall 14*a* of the outer cylindrical portion 14 may be shaped in the form of a conical inner wall which is inclined by an angle $\beta$, which is less than 5 degrees, with respect to the rotation axis of the rotary shaft 8. Furthermore, as mentioned above, the paint, injected from the paint injector 18, spreads on the cylindrical inner wall 14*a* of the outer cylindrical portion 14 in the form of a thin film. At this time, in order to prevent the paint from flowing out from the left end of the cylindrical inner wall 14*a* in FIG. 5, it is preferable that an annular projection 72, extending towards the rotation axis of the rotary shaft 8, be formed on the cylindrical inner wall 14*a* at the left end thereof in FIG. 5.

As mentioned previously, the paint, injected from the nozzle 21 of the paint injector 18, spreads on the cylindrical inner wall 14*a* of the outer cylindrical portion 14 in the form of a thin film and, then, flows out onto the inner wall 15 of the spray head body 13 via the paint outflow bores 16 due to the centrifugal force caused by the rotation of the spray head 9. After this, the paint spreads on the inner wall 15 of the spray head body 13 and flows on the inner wall 15 in the form of a thin film. Then, the paint reaches the tip 13*a* of the spray head body 13. As mentioned previously, a negative high voltage is applied to the spray head 9. Consequently, when the paint is sprayed from the tip 13*a* of the spray head body 13 in the form of fine particles, the particles of the sprayed paint are charged with electrons. Since the surface to be painted is normally grounded, the paint particles charged with electrons are attracted towards the surface to be painted due to electrical force and, thus, the surface to be painted is painted.

Figure 9:
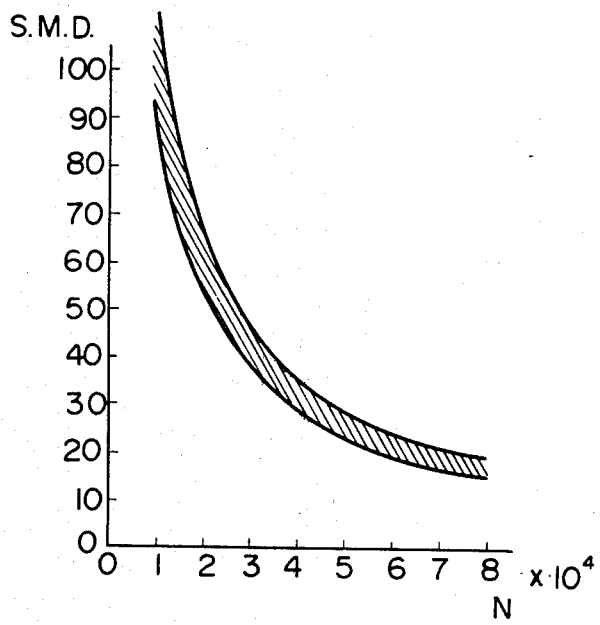
FIG. 9 is a graph showing the relationship between the size of the paint particles and the rotating speed of the spray head.

FIG. 9 illustrates the relationship between the size of the particles of sprayed paint and the rotating speed of the spray head in the case wherein the spray head 9 (FIG. 1) having a diameter of 75 mm is used. In FIG. 9, the ordinate S. M. D. indicates the mean diameter ($\mu$m) of paint particles, which is indicated in the form of a Sauter mean diameter, and the abscissa N indicates the number of revolutions per minute (r.p.m.) of the spray head 9. As mentioned previously, in a conventional rotary type electrostatic spray painting device, the maximum number of revolutions per minute N of the spray head is about 20,000 r.p.m. Consequently, from FIG. 9, it will be understood that, if the spray head having a diameter of 75 mm is used in a conventional rotary type electrostatic spray painting device, the minimum mean diameter S. M. D. of paint particles is in the range of 55 $\mu$m to 65 $\mu$m. Contrary to this, in the present invention, the maximum number of revolutions per minute N is about 80,000 r.p.m. Consequently, from FIG. 9, it will be understood that the paint can be divided into fine particles to such a degree that the mean diameter S. M. D. of paint particles is in the range of 15 $\mu$m to 20 $\mu$m. Therefore, it will be understood that, in a rotary type electrostatic spray painting device according to the present invention, the size of paint particles can be greatly reduced, as compared with that of paint particles in a conventional rotary type spray painting device. In addition, as mentioned previously, the same negative high voltage is applied to the housings 2, 3, and the rotary shaft 8. Consequently, there is no danger that an electric discharge will occur between the housings 2, 3 and the rotary shaft 8.

According to the present invention, since the spray head can be rotated at a high speed of about 80,000 r.p.m., the size of the particles of sprayed paint can be reduced to a great extent. As a result of this, the size of paint particles becomes smaller than that of paint particles obtained by using a conventional air injection type electrostatic spray painting device. Consequently, in the present invention, it is possible to form an extremely beautiful finished surface and, therefore, a rotary type electrostatic spray painting device can be used for carrying out a finish painting step in the paint process, for example, for bodies of motor cars. In addition, in the present invention, since paint particles are created by rotating the spray head at a high speed, but are not created by air injection, the amount of the paint used to effectively paint the surface to be painted is about 90 percent of the amount of the paint sprayed from a rotary type electrostatic spray painting device. Consequently, since a large part of the sprayed paint is not dispersed within the factory, it is possible to prevent the problem, previously mentioned, regarding air pollution, from arising. In addition, the amount of paint used can be reduced.

While the invention has been described by reference to specific embodiments chosen for purposes of illustration, it should be apparent that numerous modifications could be made thereto by those skilled in the art without departing from the spirit and scope of the invention.

We claim:

1. A rotary type electrostatic spray painting device comprising:

a metallic housing;

a metallic rotary shaft rotatably arranged in said housing and having a front end and a rear end;

a cup shaped metallic spray head fixed onto the front end of said rotaty shaft and having a cup shaped inner wall and an approximately cylindrical inner wall which is spaced radially inwardly from said cup shaped inner wall and defines an annular space therein, said approximately cylindrical inner wall being arranged coaxially with a rotation axis of said rotary shaft and having a plurality of paint outflow bores, each being formed in said approximately cylindrical inner wall and smoothly connected to said cup shaped inner wall;

feed means having a paint injection nozzle which is arranged in said annular space and is directed to said approximately cylindrical inner wall for feeing a paint onto said approximately cylindrical inner wall said paint injection nozzle being inclined in the direction of rotation of said spray head by a predetermined angle with respect to a radial line of said spray head which crosses said paint injection nozzle;

drive means cooperating with said rotary shaft for rotating said rotary shaft;

non-contact type radial bearing means arranged in said housing and cooperating with said rotary shaft for radially supporting said rotary shaft under a non-contacting state;

non-contact type thrust bearing means arranged in said housing and cooperating with said rotary shaft for axially supporting said rotaty shaft under a non-contacting state;

terminal means for receiving a negative high voltage, said terminal means being connected to said metallic housing, and; electrode means arranged in said metallic housing for electrically connecting said terminal means to said spray head.

2. A rotary type electrostatic spray painting device as claimed in claim 1, wherein said approximately cylindrical inner wall has a uniform diameter over the entire length thereof.

3. A rotary type electrostatic spray painting device as claimed in claim 1, wherein said approximately cylindrical inner wall has a conically shaped inner wall.

4. A rotary type electrostatic spray painting device as claimed in claim 3, wherein said conically shaped inner wall is inclined by an angle, which is less than 5 degrees, with respect to the rotation axis of said rotary shaft.

5. A rotary type electrostatic spray painting device as claimed in claim 1, wherein said paint injection nozzle is directed to a central portion of said approximately cylindrical inner wall.

6. A rotary type electrostatic spray painting device as claimed in claim 1, wherein said predetermined angle is within the range of 0 through 60 degrees.

7. A rotary type electrostatic spray painting device as claimed in claim 1, wherein said approximately cylindrical inner wall has a rear end and a front end, said paint outflow bores being formed at said front end, and an annular projection being formed on said rear end of said approximately cylindrical inner wall.

8. A rotary type electrostatic spray painting device as claimed in claim 1, wherein said non-contact type radial bearing means comprises a pair of radial air bearings.

9. A rotary type electrostatic spray painting device as claimed in claim 8, wherein each of said radial air bearings comprises a bearing frame connected to said housing, a plurality of pads, each having an inner face which extends along a circumferential outer wall of said rotary shaft and arranged to be spaced from the circumferential outer wall of said rotary shaft by a slight distance, and a plurality of support pins, each being connected to said bearing frame and pivotally supporting said corresponding pad.

10. A rotary type electrostatic spray painting device as claimed in claim 9, wherein each of said radial air bearings further comprises a resilient arm through which one of said support pins is connected to said bearing frame for biasing said corresponding pad to the circumferential outer wall of said rotary shaft.

11. A rotary type electrostatic spray painting device as claimed in claim 9, wherein each of said pads has an outer wall forming a spherical recess thereon, each of said support pins having a spherical tip which is in engagement with the spherical recess of said corresponding pad.

12. A rotary type electrostatic spray painting device as claimed in claim 1, wherein said non-contact type thrust bearing means comprises a thrust air bearing.

13. A rotary type electrostatic spray painting device as claimed in claim 12, wherein said non-contact type thrust bearing means further comprises an air feed inlet for receiving compressed air, said thrust air bearing comprising a stationary annular plate having opposed side walls, and a pair of runners fixed onto said rotary shaft and arranged on each side of said annular plate, each of said runners being spaced from the corresponding side wall of said annular plate, a plurality of air outflow bores connected to said air feed inlet and being formed on the opposed side walls of said annular plate.

14. A rotary type electrostatic spray printing device as claimed in claim 13, wherein said annular plate forms therein a plurality of radially extending air passages, each connecting said corresponding air outflow bore to said air feed inlet.

15. A rotary type electrostatic spray painting device as claimed in claim 1, wherein said electrode means comprises an electrode which is arranged to continuously contact with said rear end of said rotary shaft.

16. A rotary type electrostatic spray painting device as claimed in claim 15, wherein said electrode is made of carbon.

17. A rotary type electrostatic spray painting device as claimed in claim 15, wherein said rear end of said rotary shaft has a flat end face extending perpendicular to the rotation axis of said rotary shaft, said electrode being arranged coaxially with the rotation axis of said rotary shaft and having a flat end face which is in contact with the flat end face of the rear end of said rotary shaft.

18. A rotary type electrostatic spray painting device as claimed in claim 15, wherein said electrode means further comprises an electrode holder fixed onto said housing and having therein a cylindrical hole into which said electrode is slidably inserted, and a compression spring arranged in the cylindrical hole of said electrode holder between said electrode holder and said electrode.

19. A rotary type electrostatic spray painting device as claimed in claim 1, wherein said drive means comprises a compressor, an air injection nozzle arranged in said housing and connected to said compressor, and a tubine wheel fixed onto said rotary shaft and having a turbine blade which is arranged to face said air injection nozzle.

* * * * *